United States Patent [19]

Lusk

[11] Patent Number: 4,590,629

[45] Date of Patent: May 27, 1986

[54] TOILET VENTILATING DEVICE

[76] Inventor: Leonard A. Lusk, 19409 - 80th Ave., Surrey, B.C., Canada, V3S 4P1

[21] Appl. No.: 635,275

[22] Filed: Jul. 27, 1984

[51] Int. Cl.[4] ..... E03D 9/04

[52] U.S. Cl. ..... 4/213; 4/209 R

[58] Field of Search ..... 4/209 R, 209 FF, 210–211, 4/214–217, 347–352, DIG. 9, 213; 55/256, 255

[56] References Cited

U.S. PATENT DOCUMENTS

| | | | |
|---|---|---|---|
| 1,594,324 | 7/1926 | Payne | 55/256 |
| 2,105,794 | 1/1938 | Norris . | |
| 2,279,789 | 4/1942 | Jentzer | 4/213 |
| 2,405,494 | 8/1946 | Dupuy | 55/256 |
| 2,846,696 | 8/1958 | Herriott | 4/213 |
| 3,066,317 | 12/1962 | Cawiezel | 4/213 |
| 3,087,168 | 4/1963 | Huso | 4/213 |
| 3,192,539 | 7/1965 | Martz | 4/213 |
| 3,316,693 | 5/1967 | Fermor | 55/256 |
| 3,561,194 | 2/1971 | Baldwin | 55/249 |
| 3,585,651 | 6/1971 | Cox | 4/348 |
| 3,626,554 | 12/1971 | Martz | 4/213 |
| 3,691,568 | 9/1972 | Martz | 4/213 |
| 3,695,005 | 10/1972 | Yuzawa | 55/255 |
| 3,740,772 | 6/1973 | Paley | 4/217 |
| 3,756,580 | 9/1973 | Dunn | 55/255 |
| 3,763,505 | 10/1973 | Zimmerman | 4/352 |
| 3,781,923 | 1/1974 | Maisch et al. | 4/213 |
| 3,913,150 | 10/1975 | Poister et al. | 4/213 |
| 3,999,225 | 12/1976 | Ables | 4/217 |
| 4,031,574 | 6/1977 | Werner | 4/213 |
| 4,094,023 | 6/1978 | Smith | 4/213 |
| 4,125,906 | 11/1978 | Weiland | 4/217 |
| 4,153,956 | 5/1979 | Fischer, Sr. et al. | 4/213 |
| 4,165,544 | 8/1979 | Barry | 4/213 |
| 4,166,298 | 9/1979 | Pearson | 4/213 |
| 4,174,545 | 11/1979 | Smith, Jr. | 4/217 |
| 4,200,940 | 5/1980 | Buchanan | 4/348 |
| 4,282,017 | 8/1981 | Chen | 55/247 |

*Primary Examiner*—Stephen Marcus
*Assistant Examiner*—Linda J. Sholl

[57] ABSTRACT

A toilet ventilating device with an air pump having an inlet and an outlet. An odor outlet fitting is adapted to communicate with the toilet bowl and the inlet of the air pump. An odor outlet fitting is adapted to communicate between water in the water reservoir of the toilet (typically the water tank), and the air pump outlet. This fitting preferably includes a gas diffuser. Air is withdrawn from the toilet bowl and discharged into the water reservoir through the outlet fitting, such that water in the water reservoir will filter the odorous gases.

3 Claims, 4 Drawing Figures

TOILET VENTILATING DEVICE

FIELD OF THE INVENTION

This invention relates to a toilet ventilating device, constructed to reduce odors which normally escape from a toilet bowl when in use.

DESCRIPTION OF PRIOR ART

The generally accepted approach to disposing of odors associated with the use of a toilet, is to provide a fan which withdraws air from the room in which the toilet is located, and typically expels it to the outside of the building in which such room is located. Such a solution of course requires expulsion of fairly large amounts of air from such room (which is time consuming and may be a waste of heated room air), since the relatively small initial amount of odorous gases from the human body, have already had an opportunity to mix with the air in the room. In addition, some of the odor may then have an opportunity to escape from the room. Further, the user of the toilet must himself be subjected to the odors.

It has long been recognized that it would be useful to withdraw odors associated with the use of a toilet, directly from the bowl of the typical toilet. This has been accomplished in the past by providing a fan which withdraws air from the toilet bowl, and expels it to the outside of the building in which the room is located, or in some cases passes it through a charcoal filter for odor removal. A large variety of such devices have been disclosed in the past. Such device included those in U.S. Pat. No. 2,105,794 to Norris, U.S. Pat. No. 3,691,568 to Martz, U.S. Pat. No. 3,626,554 to Martz, as well as others. Some further devices include means whereby air is withdrawn from the toilet bowl through specially constructed toilet seats, or through special fittings adapted to mount adjacent the toilet bowl rim. Such devices include those disclosed in U.S. Pat. No. 4,200,940 to Buchanan, U.S. Pat. 3,913,150 to Polster et al, U.S. Pat. No. 3,999,225 to Ables, U.S. Pat. No. 4,125,906 to Weiland, U.S. Pat. No. 3,740,772 to Paley, and U.S. Pat. No. 4,094,023 to Smith.

Other arrangements have been disclosed whereby air is drawn from the toilet bowl through the overflow pipe located in a typical toilet water tank, the withdrawing of air being accomplished by an air pump, either having its inlet connected directly to the overflow pipe, or communicating with the air space above the level of water normally dispose within the water tank. Such arrangement are disclosed in U.S. Pat. No. 3,763,505 to Zimmerman, U.S. Pat. No. 3,781,923 to Maisch et al, U.S. Pat. No. 4,165,544 to Barry, U.S. Pat. No. 4,153,956 to Fischer Sr. et al, U.S. Pat. No. 3,626,554 to Martz, and U.S. Pat. No. 4,165,544 to Barry. In addition, the direct air pump has been replaced by a venturi device as disclosed in U.S. Pat. No. 4,165,544 to Barry. In addition, the use of water to cleanse exhaust gases, typically exhaust gases from an automobile internal combustion engine, has been disclosed in the past. Such arrangements have been disclosed, for example in U.S. Pat. No. 3,695,005 to Yuzawa, U.S. Pat. No. 4,282,017 to Chen, U.S. Pat. No. 3,756,580 to Dunn and U.S. Pat. No. 3,561,194 to Baldwin.

SUMMARY OF THE INVENTION

The present invention provides an arrangement whereby odorous gases can be withdrawn directly from the toilet bowl, and are treated to reduce odors by passing such gases into water, typically in a water reservoir of the toilet, which is preferably the toilet water tank. In this regard, a toilet ventilating device is provided for use with a toilet having a bowl and a water reservoir, which ventilating device comprises an air pump with an inlet and an outlet. An odor inlet fitting is adapted to communicate with the toilet bowl and the inlet of the air pump. That is, the fitting can communicate directly to the toilet bowl, or alternatively indirectly by communicating with some component on the toilet, such as an overflow pipe, which in turn communicates with the toilet bowl. This arrangement is such that air can be drawn from the toilet bowl through the odor inlet fitting. Further, an odor outlet fitting is adapted to communicate between water in the water reservoir of the toilet, and the air pump. This arrangement is such that air from the air pump outlet can pass into water in the water reservoir of the toilet.

Advantageously, the odor outlet fitting comprises a gas diffuser which is adapted to be placed in the water tank, and in communication with the air pump outlet.

The odor inlet fitting usefully comprises an adaptor dimensioned to fit over the upper end of an overflow pipe in the water tank. The dimensioning is such that air can normally be withdrawn through the overflow pipe, and water can overflow into the overflow pipe. Typically, this is accomplished by having the adaptor includes an exhaust pipe which has an opening in at least one end, such that the exhaust pipe can be positioned over the overflow pipe and extend downwardly about the overflow pipe. The adaptor further additionally usefully comprises conduit means communicating with the interior of the exhaust pipe, and which is for snuggly communicating with a bowl rinse water line in the toilet tank. Usefully, the diffuser and the air pump are mounted on the exhaust pipe.

In another arrangement, the odor inlet fitting is dimensioned to mount adjacent the rim of the toilet bowl. In particular the odor inlet fitting may usefully comprise a nozzle which is dimensioned to mount between the rim of the toilet bowl, and beneath a seat thereon. Usefully, the nozzle is mounted on the pump so that the pump is suspended from the nozzle when the nozzle is mounted on the toilet bowl.

A method of ventilating odors from a toilet as described, is also provided which comprises withdrawing air from the bowl and discharging it into water, typically in the water reservoir, and again preferably in the toilet tank. The discharge preferably takes place through a diffuser disposed in the water in the water tank.

DRAWINGS

Embodiments of the invention will now be described with reference to the drawings, in which.

DETAILED DESCRIPTION OF EMBODIMENTS OF THE INVENTION

Figure 1:
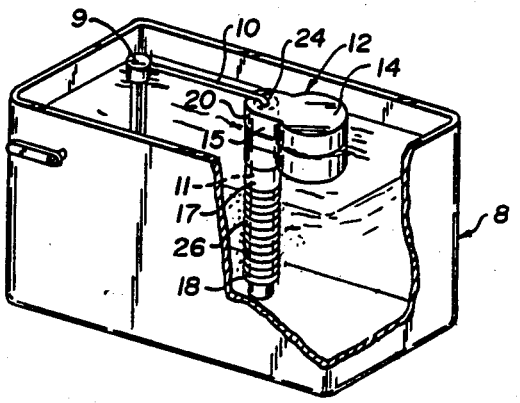
FIG. 1 is a prespective, partially cut away view, of a typical toilet tank showing an embodiment of the toilet ventilating device installed therein.

Referring first to the embodiment of the invention shown in FIG. 1, numeral 8 represents a typical water reservoir, of a typical toilet in the form of a toilet tank. Toilet tank 8 is of a well known construction. Toilet tank 8 includes a float valve 9 controlled by a float (not shown) and from which extends a bowl rinse water line 10. An overflow pipe 11 extends upwardly from the lower surface of toilet tank 8. All of the foregoing is again of well known construction.

A toilet ventilating device generally designated 12 is disposed within toilet tank 8, ventilating device 12 and tank 8 together forming a toilet ventilating system. Toilet ventilating device 12 includes an air pump 14 having an inlet end 15, as well as an outlet. Ventilating device 12 further includes an adapter in the form of an exhaust pipe 17, of a diameter greater than overflow pipe 11, and which has a lower end 18 and upper end 20 integral with the inlet end 15 of pump 14. Upper end 20 of pipe 17 includes a surface portion 24 with an opening which acts as conduit means communicating with the interior of exhaust pipe 17. Such opening is arranged to snuggly communicate with bowl rinse pipe 10 in the manner shown in FIG. 1, such that air cannot pass into air pump inlet 15 through the opening for bowl rinse pipe 10.

Figure 2:
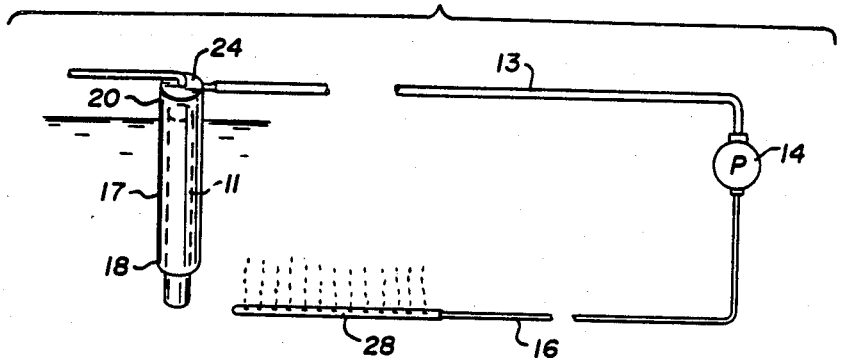
FIG. 2 is a schematic view of an alternate embodiment of the ventilating device of the present invention.

A gas diffuser 26 is conveniently mounted on exhaust pipe 17, and connected by a hose similar to a hose 13 of the embodiment of FIG. 2 to be described, to the outlet of pump 14. Alternatively, a diffuser 28, can be positioned on the bottom of tank 8 and connected to the outlet of pump 14 through line 16 adjacent the outside of boiler bowl rim 3. The diffuser 26 or 28, in conjunction with the line connecting it to the outlet of pump 14, forms an odour outlet fitting.

The ventilating device 12 as described in connection with FIG. 1, is connected to the toilet bowl 8 in the manner again shown in FIG. 1. Exhaust pipe 17 is maintained in position on overflow pipe 10 simply by gravity as a result of its weight and that of attached components, plastic spacers, or other means which will be evident to one skilled in the art. Portion 24 of exhaust pipe 17 connects to water line 10 by means of an expandable rubber nipple on portion 24 which can sealingly engage water line 10. Alternatively, flush line 10 can be an integral part of ventilating device 12, with a situable means being provided for connection to valve 9 of tank 8. When diffuser 28 and line 16 is used, diffuser 28 may simply be positioned on the bottom of tank 8. The positioning of the diffuser is of course not critical, as long as it is positioned below the normal water level in tank 8. However, the greater the depth of the diffuser below the normal water level in tank 8, the greater the filtering effect which will be obtained.

In operation, pump 14 is connected to any situable source of electrical power. Typically this will be AC power as pump 14 will most conveniently be the well known type of vibrator pump utilized in aerating small fish tanks. However, if another type of pump is utilized, or situable circuitry is provided, it will be obvious that D.C. power could also be utilized in the form of batteries which if desired, could be mounted in a suitable housing directly on ventilating device 12. When the toilet is in use, the water level will normally be at that position shown in FIG. 1. Air (and this term includes odorous gases) will be withdrawn from the bowl of the toilet and up through overflow pipe 11, by virtue of pump 14. Such gases will then be discharged through the outlet of pump 14 and hence through the line connecting the outlet to diffuser 26, or alternatively through line 16 connecting diffuser 28. The air (again including odorous gases) will then pass upwardly through water in water tank 8, thereby filtering out much of the odorous gases. It will be noted that by virtue of the snug fit between portion 24 of exhaust pipe 17, and water line 10, that air can only enter the inlet of pump 14 when the water is at its normal level in tank 8, by virtue of being withdrawn up overflow pipe 10. Of course, when the toilet is flushed, air will for a short time be able to enter up the lower end 18 of pipe 17. However, this will not be critical since the toilet is normally only flushed after use of it is completed. Even if this was not the case, the water level in water tank 8 will again shortly reach the lower end 18 of pipe 17, such that air would again only be drawn up overflow pipe 10.

It will be noted by virtue of the above arrangement, that the original functions of the toilet are preserved. For example, the water level within exhaust pipe 17 will always be approximately the same as that within the tank generally. Thus, should the water level in tank 8 become too high, water will be drained from tank 8 through overflow pipe 11, to overflow in the usual manner. In addition, water from water line 10 will also be able to pass down into overflow pipe 11 to rinse the toilet bowl in the usual manner when the toilet is flushed.

FIG. 2 shows an arrangement similar to that of FIG. 1, with analogous parts in both figures being numbered identically, except in FIG. 2 the pump 14 is no longer mounted upon pipe 17, but is separated therefrom. In this case, hose 13 connects the upper end of exhaust pipe 17 with the inlet of pump 14, while hose 16 may be lenghtened somewhat, depending upon the desired location of pump 14.

Figure 3:
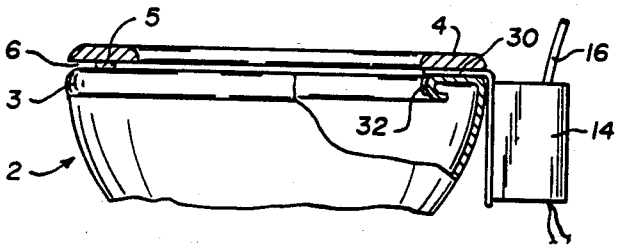
FIG. 3 is a partially cut away, partial side elevation, of a toilet bowl, and showing another embodiment of the toilet ventilating device of the present invention, installed thereon.
Figure 4:
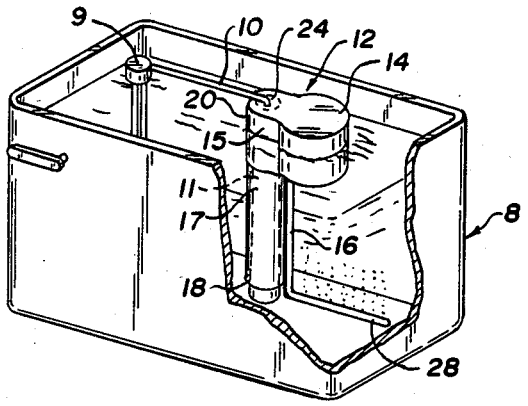
FIG. 4 is a view of similar to FIG. 1 but showing the embodiment of FIG. 2 of the present invention.

FIG. 3 shows a portion of a typical toilet bowl, labelled generally as 2. Again, analogous parts in the embodiments of the figures have been identically numbered. Bowl 2 has a rim 3, and is provided with a seat thereon. Seat 4 is typically provided with spacers 5 so that there is a gap 6 between seat 4 and toilet bowl rim 3. The odor inlet fitting in the embodiment of the ventilating device of FIG. 3, consists of nozzle 30 made of a rigid material, and communicating with the inlet of pump 14. Nozzle 30 includes lip 32, which extends part way around the inside of toilet bowl rim 3 as shown in FIG. 3. By the arrangement of nozzle 30, nozzle can be mounted on toilet bowl 2 in the manner shown in FIG. 3, such that pump 14 is suspended from nozzle 30.

It will be appreciated of course that a variety of odor inlet fittings can be used which communicate with the inlet of the air pump. Such fittings include many inlet fittings as shown in the patents earlier mentioned in this application. Further, different outlet fitting arrangements can also be used. However, it is of course important for the present application that such outlet fittings communicate with water in a water reservoir of the toilet. Again the water reservoir would typically be the toilet tank, although such could conceivably include the water reservoir normally in a toilet bowl). Such communication allows odorous gases withdrawn from the toilet bowl by the pump, to be filtered by water in such water reservoir. Each time the toilet is flushed of course, the filter material, namely water, is completely changed.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

I claim:

1. A toilet ventilating device for use with a toilet having a bowl and a water tank, comprising:

(a) an air pump having an input and an outlet;

(b) an odor inlet fitting adapted to communicate with the toilet bowl and the inlet of said air pump, so that air can be drawn from the toilet bowl through said odor inlet fitting, said odor inlet fitting comprising an adaptor dimensioned to fit over the upper end of an overflow pipe in the water tank, so that air can normally be withdrawn through the overflow pipe, and water can overflow into it, said adaptor comprising an exhaust pipe having an opening in one end such that the pipe can be positioned over the overflow pipe and extend downwardly thereabout; and (c) an odor outlet fitting adapted to communicate between water in the water tank of the toilet, and the air pump outlet, so that air from the air pump outlet can pass into water in the water tank of the toilet, said odor outlet fitting comprising a gas diffuser adapted to be placed in the water tank and in communication with the air pump outlet.

2. A toilet ventilating device as described in claim 1 wherein the adaptor comprises conduit means communicating with the interior of the exhaust pipe, for snugly communicating with a bowl rinse water line in the toilet tank.

3. A toilet ventilating device as described in claim 2 wherein the diffuser and said air pump are mounted on the exhaust pipe.

* * * * *